US009690260B2

(12) United States Patent
Verardo et al.

(10) Patent No.: US 9,690,260 B2
(45) Date of Patent: Jun. 27, 2017

(54) METHOD FOR ADJUSTING THE OSCILLATION FREQUENCY OF A SPRUNG BALANCE ASSEMBLY

(75) Inventors: Marco Verardo, Les Bois (CH); Emmanuel Graf, Le Locle (CH); Philippe Barthoulot, Maiche (FR); Nicola Giusto, Le Locle (CH); Sacha Vorpe, Sonvilier (CH)

(73) Assignee: Nivarox-FAR S.A., Le Locle (CH)

( * ) Notice: Subject to any disclaimer, the term of this patent is extended or adjusted under 35 U.S.C. 154(b) by 491 days.

(21) Appl. No.: 14/239,965

(22) PCT Filed: Sep. 5, 2012

(86) PCT No.: PCT/EP2012/067327

§ 371 (c)(1),
(2), (4) Date: Feb. 20, 2014

(87) PCT Pub. No.: WO2013/034597

PCT Pub. Date: Mar. 14, 2013

(65) Prior Publication Data

US 2014/0157601 A1 Jun. 12, 2014

(30) Foreign Application Priority Data

Sep. 5, 2011 (EP) ..... 11180071

(51) Int. Cl.
*G04D 7/12* (2006.01)
*G04D 7/08* (2006.01)
(Continued)

(52) U.S. Cl.
CPC ..... *G04D 7/1292* (2013.01); *G04B 17/06* (2013.01); *G04B 18/006* (2013.01); *G04D 7/085* (2013.01); *Y10T 29/49581* (2015.01)

(58) Field of Classification Search
CPC .... G04D 7/1292; G04D 7/085; G04B 18/006; G04B 17/06; Y10T 29/49581
See application file for complete search history.

(56) References Cited

U.S. PATENT DOCUMENTS 2,554,033 A * 5/1951 Kohlhagen ..... G01M 1/30 73/481
2,745,287 A * 5/1956 Kohlhagen ..... F16F 15/32 73/481

FOREIGN PATENT DOCUMENTS

CH 702 708 8/2011

OTHER PUBLICATIONS

Human Translation of XP002511514 Pairing of the Pendulum and the Balance Spring, Jan. 1998.*
(Continued)

*Primary Examiner* — Ryan J Walters
(74) *Attorney, Agent, or Firm* — Oblon, McClelland, Maier & Neustadt, L.L.P.

(57) ABSTRACT

A method adjusting oscillation frequency of a sprung balance assembly formed at random from balance springs and balance wheels. A production mechanism is set to limit a sample standard deviation of a single batch of balance springs to a predetermined maximum value, and to limit a sample standard deviation of a single batch of balance wheels to a predetermined maximum value within a given unbalance tolerance. The mean of the balance population is classified according to the mean of the balance springs, to obtain a difference corresponding to a maximum inertia decrease value of the balances, between extreme gaussian distribution values of balances and of balance springs. A random balance spring sample is taken from the single batch of balance springs and a random balance from among the single batch of balances. The inertia of the balance is
(Continued)

adjusted according to a torque value of the balance spring sample.

19 Claims, 1 Drawing Sheet

(51) Int. Cl.
*G04B 17/06* (2006.01)
*G04B 18/00* (2006.01)

(56) References Cited

OTHER PUBLICATIONS

Reymondin, C.A., Ed, et al., "Theorie d'horlogerie, L'appairage du balancier et du spiral", Theorie D'Horlogerie, Federation Des Ecoles Techniques De Suisse, p. 146, (Jan. 1, 1998) XP 002511514.
Reymondin, C.A., Ed, et al., "Theorie d'horlogerie, Le balancier", Theorie D'Horlogerie, Federation Des Ecoles Techniques De Suisse, pp. 136-137, (Jan. 1, 1998) XP 002671773.
Reymondin, C.A., Ed, et al., "Theorie d'horlogerie, Le spiral", Theorie D'Horlogerie, Federation Des Ecoles Techniques De Suisse, pp. 138-141, (Jan. 1, 1998), XP 002671774.
Benguin, P., "Le balancier modern", Journal Suisse D'Horlogerie et de Bijouterie pp. 569-575, (Sep. 1968) XP 001219610.
International Search Report Issued Oct. 9, 2012 in PCT/EP12/067327 Filed Sep. 5, 2012.

* cited by examiner

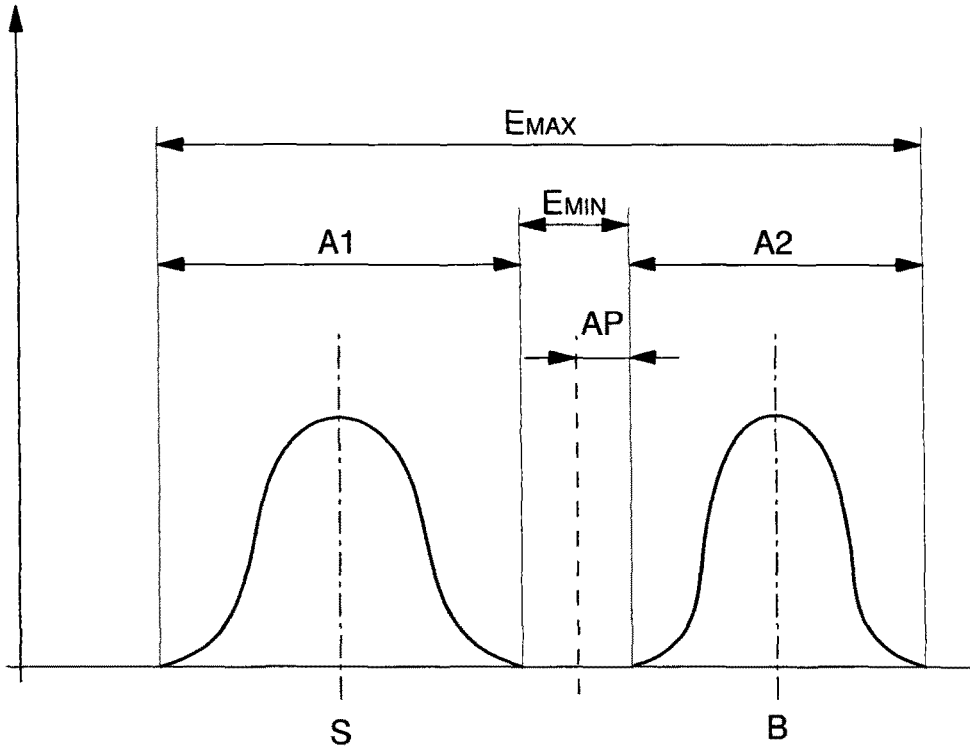
EMAX
EMIN
A1
A2
AP
S
B

METHOD FOR ADJUSTING THE OSCILLATION FREQUENCY OF A SPRUNG BALANCE ASSEMBLY

CROSS-REFERENCE TO RELATED APPLICATIONS

This is a National Phase Application in the United States of International Patent Application PCT/EP2012/067327 filed Sep. 5, 2012, which claims priority on European Patent Application No. 11180071.0 of Sep. 5, 2011, the entire contents of each of which are incorporated herein by reference.

FIELD OF THE INVENTION

The method concerns a method for adjusting the oscillation frequency of a timepiece sprung balance assembly formed at random from among a total output of balance springs and an output of balance wheels.

The invention concerns the field of the manufacture of timepiece components and in particular the manufacture of regulating assemblies, and the operation of adjusting the frequency setting thereof.

BACKGROUND OF THE INVENTION

Conventionally, as described in particular in "*The Theory of Horology*" by C. A. Reymondin et al., ISBN 978-2-940025-10-7, published by the Swiss Federation of Technical Colleges, Lausanne, the balances and balance springs are manufactured, and then sorted into a large number of grades. To form a sprung balance assembly capable of oscillating close to a certain oscillation frequency, a balance and a balance spring should thus each be taken from a grade capable of achieving close to this frequency, then the pair thereby formed should be adjusted to obtain the actual desired frequency, by adjusting the length of the balance spring, and/or by modifying the moment of inertia of the balance.

Consequently, a huge volume of goods in production is required to satisfy demand. Despite the goods in production, it is still necessary to carry out operations on the balance spring and balance, which are not ready for use.

The precision of frequency adjustment naturally depends on the range of each grade of balance spring and balance, which explains the high number of grades.

SUMMARY OF THE INVENTION

The invention proposes to obviate the need for these extremely expensive goods in production, and to set in place a new method which makes it possible, extremely quickly and economically, to manufacture sprung balances which are correctly set at a given oscillation frequency.

The invention also proposes to address the necessary problem of poising the balances at the same time.

The invention therefore concerns a method of adjusting the oscillation frequency of a timepiece sprung balance assembly formed at random from among a total output of balance springs and an output of balance wheels, characterized in that, to avoid the need for any grading of balances and balance springs:

the means of producing said balance springs is set to a predetermined mean value, and said balance spring production means is set to limit the sample standard deviation of said balance spring output to a predetermined maximum value, the means of producing said balances is set to a predetermined mean value, and said balance production means is set to limit the sample standard deviation of said balance output to a predetermined maximum value and within a given unbalance tolerance for said total population of balances, to produce the output:

on the one hand of a single batch of balance springs of a given type, whose mean is capable of a given oscillation frequency for a predetermined balance wheel inertia, each of said balance springs being finished, cut for pinning up to the stud and ready for assembly, and forming a single population of balance springs whose sample standard deviation is peculiar to said single batch output concerned, and on the other hand a single batch of balances of a given type, whose mean is capable of said given oscillation frequency for a predetermined balance spring torque and forming a single population of balances whose sample standard deviation is peculiar to said single batch output concerned, the manufacturing parameters are determined in accordance with normal production laws for said balances and said balance springs in order to classify said balance population mean according to said balance spring population mean, so that there exists a difference corresponding to a maximum value for the allowable decrease in inertia for each said balance, between the extreme values of:

on the one hand the gaussian distribution of theoretical frequency values for each balance as a function of said reference balance spring torque, and on the other hand the gaussian distribution of the theoretical frequency values for each balance spring as a function of said reference inertia of the balance, a random balance spring sample is taken from said single balance spring batch, and a random balance sample is taken from said single batch of balances, if necessary machining is carried out to adjust the poising of said balance sample to bring it within a given poising tolerance, and a complementary inertia adjustment operation is carried out, depending on the torque value of said balance spring sample, in order to form a sprung balance assembly capable of oscillating at said oscillation frequency after said inertia adjustment operation has been performed on said balance.

BRIEF DESCRIPTION OF THE DRAWINGS

The Figure shows a schematic view of the statistical distribution of the total balance spring population and of the total balance population in the implementation of the invention.

DETAILED DESCRIPTION OF PREFERRED EMBODIMENTS

The invention concerns a method for adjusting the oscillation frequency of a timepiece sprung balance assembly. This timepiece sprung balance assembly is formed at random from a total output of balance springs and an output of balances.

According to this method, to avoid the need to grade the balances and balance springs, the following operations are performed:

the means of producing said balance springs is set to a predetermined mean value ms, and said balance spring production means is set to limit the sample standard deviation as of said balance spring output to a predetermined maximum value σsMax, the means of producing said balances is set to a predetermined mean value mb, and said balance production means is set to limit the sample standard deviation σb of said balance output to a predetermined maximum value σbMax and within a given unbalance tolerance for said total population of balances, to produce the output:

on the one hand of a single batch of balance springs of a given type, whose mean is capable of a given oscillation frequency N0 for a predetermined balance wheel inertia J0, each of the balance springs being finished, cut for pinning up to the stud and ready for assembly, and forming a single population of balance springs whose sample standard deviation is peculiar to the single batch output concerned, and on the other hand a single batch of balances of a given type, whose mean is capable of the given oscillation frequency N0 for a predetermined balance spring torque C0 and forming a single population of balances whose sample standard deviation is peculiar to the single batch output concerned, the manufacturing parameters are determined in accordance with normal production laws for balances and balance springs in order to classify said balance population mean mb according to said balance spring population mean ms, so that there remains a difference corresponding to a maximum value for the allowable decrease in inertia for each said balance, between the extreme values of:

on the one hand the gaussian distribution of theoretical frequency values for each balance as a function of the reference balance spring torque C0, and on the other hand the gaussian distribution of the theoretical frequency values for each balance spring as a function of the reference inertia J0 of the balance, a random balance spring sample Sx is taken from the single balance spring batch and a random balance sample By is taken from the single batch of balances, if necessary machining is carried out to adjust the poising of the balance sample By to bring it within a given poising tolerance, and a complementary inertia adjustment operation is carried out, depending on the torque value of the balance spring sample Sx, in order to form a sprung balance assembly capable of oscillating at the oscillation frequency N0 after the inertia adjustment operation has been performed on the balance.

The production follows a normal law, whose parameters are peculiar to each batch output. It is clear that the amplitude may vary according to the batch output. Some batches will thus have greater sample standard deviations than others.

The advantage of the invention is that it samples a balance spring from among the total balance spring output without having to break down the total balance spring population into grades, as in the prior art. The same is true for sampling a balance, which is taken at random from among a total output. The goods in production are consequently limited to a single output of balance springs, and to a single balance output.

According to a particular feature of the invention, the inertia adjustment operation consists in carrying out, simultaneously or in series:

a machining operation to adjust the poise of the balance sample By to bring it within a given poising tolerance if the unbalance of balance sample By is greater than the given poising tolerance, and a complementary machining operation to adjust the inertia of balance By, according to the torque, measured earlier, of the balance spring sample Sx, so as to form a sprung balance assembly Sx-By capable of oscillating at oscillation frequency N0 after the inertia adjustment operation.

According to a particular feature of the invention, the difference corresponding to an allowable decrease in inertia for each balance is limited to the maximum unbalance tolerance value.

According to a particular feature of the invention, a material-removal machining process is carried on balance By for a first implementation without poising, and then, after measuring the unbalance of balance By and calculating the machining definition, there is a machining operation for poising and setting the inertia a second time to a value calculated so that the sprung balance assembly Sx-By oscillates at oscillation frequency N0.

Any material-removal machining process can be performed here by laser, milling, turning or other means.

According to a particular feature of the invention, in a particular embodiment, particularly to expose counterfeiting, a material-removal machining process is performed on balance By reserving certain first surfaces of balance By for this first inertia setting machining operation, and reserving certain second surfaces of balance By for this poising and second inertia setting machining operation.

According to a particular feature of the invention, the first surfaces are determined as being distinct from the second surfaces of balance By.

According to a particular feature of the invention, the first surfaces and the second surfaces of balance By are defined by at least prohibiting any machining in certain third areas of balance By reserved for areas of reduction or for receiving poising inertia blocks or additional components.

According to a particular feature of the invention, the first surfaces and second surfaces of balance By are defined by at least prohibiting any machining on the arms of balance By.

According to a particular feature of the invention, the poising adjustment machining process is performed symmetrically relative to a plane passing through the pivot axis of balance By and in proximity to said plane.

According to a particular feature of the invention, at least the first inertia setting machining operation is performed symmetrically relative to the pivot axis of balance By.

According to a particular feature of the invention, the volume of material to be removed from each machining area is calculated, and the flow of material is distributed over a sufficient surface area to respect the minimum predefined sections in the various areas of balance By, so as to prevent any problem of fatigue resistance.

According to a particular feature of the invention, the volume of material to be removed from each machining area is calculated so as not to exceed a certain predefined mass flow relative to the total mass of balance By, and the flow of material on the surfaces is distributed sufficiently far away from the pivot axis of balance By to attain the inertia value calculated for balance By.

According to a particular feature of the invention, after the final inertia adjustment of balance By to form a sprung balance assembly Sx-By with oscillation frequency N0, depending on the measured torque of balance spring Sx, balance spring Sx and balance By are driven onto each other up to the mark.

According to a particular feature of the invention, to perform the inertia setting, machining operations of order n symmetry are carried out.

According to a particular feature of the invention, a primary elementary frequency amplitude AP is defined, corresponding to a relative reference period variation VR0, and a tolerance is attributed to:

the balance spring population as regards the balance spring torque in a first amplitude A1 such that the first amplitude is a multiple by a first factor k1 of primary amplitude AP, the balance population as regards the inertia of the balances in a second amplitude A2 such that the second amplitude is a multiple by a second factor k2 of primary amplitude AP, the second range of distribution of the relative period variations of which the balances are capable extending beyond the first range of distribution of relative period variations of which the balance springs are capable, with, between the second range and the first range, a difference which is a multiple by a third factor k3 of primary amplitude AP, and, between the balance and the balance spring theoretically the furthest apart as regards their category of relative period variation, a difference which is a multiple by a factor k4 of primary amplitude AP.

According to a particular feature of the invention, the fourth factor k4 is defined to be close to double the value of the first factor k1, which is in turn close to double the value of second factor k2, which is close to four times the value of third factor k3.

According to a particular feature of the invention, the third factor k3 is defined with a value of two.

According to a particular feature of the invention, primary amplitude AP is defined to correspond to a relative reference period variation VR0 close to 100 seconds per day.

According to a particular feature of the invention, the difference between the second range and the first range, which is a multiple by the third factor k3 of primary amplitude AP, is employed to adjust the poising of the random balance sample By.

According to a particular feature of the invention, the poising adjustment of random balance sample By is performed by material removal, and the inertia adjustment of balance By is also performed by material-removal to form a sprung balance assembly Sx-By of oscillation frequency N0, according to the measured torque of balance spring Sx.

The invention makes it possible to drastically reduce the number of goods in production. The invention makes it possible to almost instantaneously obtain a sprung balance assembly tuned to a particular frequency, with high reliability and high precision.

The invention claimed is:

1. A method for adjustment of an oscillation frequency of a timepiece sprung balance assembly formed at random from among a total output of balance springs and an output of balance wheels to obviate a need for any grading of the balance wheels and balance springs:

wherein a predetermined mean value is set to produce said balance springs, and in order to limit a sample standard deviation of said output of said balance springs to a predetermined maximum value, wherein a predetermined mean value is set to produce balances, and in order to limit a sample standard deviation of said output of said balances to a predetermined maximum value and within a given unbalance tolerance for a total population of said balances, wherein:

a mean of a single batch of balance springs of a given type produces a given oscillation frequency for a predetermined balance wheel inertia, each of said balance springs being finished, cut to be pinned up to a stud and ready for assembly, and forming a single population of balance springs whose sample standard deviation is peculiar to an output of said single batch of balance springs, and a mean of a single batch of balances of a given type produces a given oscillation frequency for a predetermined balance spring torque and forming a single population of balances whose sample standard deviation is peculiar to an output of said single batch of balances, the method comprising:

determining manufacturing parameters for said balances and said balance springs in order to classify said mean of the population of the balances according to said mean of the population of the balance springs, so that there exists a difference corresponding to a maximum allowable value of a decrease in inertia for each said balance, between extreme values of:

a gaussian distribution of theoretical frequency values for each balance as a function of said reference balance spring torque, a gaussian distribution of theoretical frequency values for each balance spring as a function of said reference inertia of the balance;

taking a random balance spring sample from said single balance spring batch, and taking a random balance sample from said single batch of balances, measuring a torque value of said balance spring sample, machining said balance sample to adjust the unbalance of said balance sample to bring the unbalance within a given unbalance tolerance, and carrying out a complementary inertia adjustment operation of said balance sample taking into account the torque value of said balance spring sample, in order to form a sprung balance assembly oscillating at said oscillation frequency after said inertia adjustment operation has been performed on said balance.

2. The method according to claim 1, wherein said inertia adjustment operation comprises carrying out:

a complementary machining operation to adjust the inertia of said balance, as a function of the torque, measured earlier, of said balance spring sample, simultaneously or in series with the machining when the unbalance of said sample is greater than the given unbalance tolerance, so as to form a sprung balance assembly oscillating at said oscillation frequency after said inertia adjustment operation.

3. The method according to claim 2, wherein the volume of material to be removed from each machining area is calculated and the flow of material is distributed over a sufficient surface area to respect predefined minimum sections in the various areas of said balance.

4. The method according to claim 2, wherein the volume of material to be removed from each machining area is calculated so as not to exceed a certain predefined mass flow relative to the total mass of said balance, and the flow of material on the surfaces is distributed sufficiently far away from the pivot axis of said balance to attain the inertia value calculated for said balance.

5. The method according to claim 2, wherein, after the final inertia adjustment of said balance to form a sprung balance assembly with said oscillation frequency, according to the measured torque of said balance spring, said balance spring and said balance are driven onto each other up to a mark.

6. The method according to claim 1, wherein the difference corresponding to an allowable decrease in inertia for each balance is limited to said maximum unbalance tolerance value.

7. The method according to claim 1, wherein the machining includes a material-removal machining process that is carried out on said balance for a first implementation without poising, and further includes, after measuring the unbalance of said balance and calculating the machining definition, a machining operation to poise and set the inertia a second time to a value calculated so that said sprung balance assembly oscillates at said oscillation frequency.

8. The method according to claim 7, wherein the material-removal machining operation is performed on said balance by reserving certain first surfaces of said balance for said material-removal machining process, and reserving certain second surfaces of said balance for said machining operation.

9. The method according to claim 8, wherein said first surfaces are determined as being distinct from said second surfaces of said balance.

10. The method according to claim 8, wherein said first surfaces and said second surfaces of said balance are defined by at least prohibiting any machining in certain third areas of said balance reserved for areas of reduction or for receiving unbalance inertia blocks or additional components.

11. The method according to claim 8, wherein said first surfaces and said second surfaces of said balance are defined by at least prohibiting any machining on the arms of said balance.

12. The method according to claim 8, wherein at least said first inertia setting machining operation is performed symmetrically relative to the pivot axis of said balance.

13. The method according to claim 1, wherein said unbalance adjustment machining operation is performed symmetrically relative to a plane passing through the pivot axis of said balance and in proximity to said plane.

14. The method according to claim 1, wherein a primary elementary frequency amplitude is defined, corresponding to a reference relative period variation, and a tolerance is attributed to:

said balance spring population as regards said balance spring torque in a first amplitude such that said first amplitude is a multiple by a first factor of said primary amplitude, said balance population as regards the inertia of said balances in a second amplitude such that said second amplitude is a multiple by a second factor of said primary amplitude, the second range of distribution of the relative period variations of which said balances are capable extending beyond the first range of distribution of relative period variations of which the balance springs are capable, with, between said second range and said first range, a difference which is a multiple by a third factor of said primary amplitude, and, between the balance and the balance spring theoretically the furthest apart as regards the category of relative period variation thereof, a difference which is a multiple by a factor of said primary amplitude.

15. The method according to claim 14, wherein said fourth factor is defined to be close to double the value of said first factor, which is in turn close to double the value of said second factor, which is close to four times the value of said third factor.

16. The method according to claim 14, wherein said third factor is defined with a value of two.

17. The method according to claim 14, wherein said primary amplitude is defined to correspond to a relative reference period variation close to 100 seconds per day.

18. The method according to claim 14, wherein said difference between said second range and said first range, which is a multiple by said third factor of said primary amplitude, is employed to adjust the unbalance of said random balance sample.

19. The method according to claim 18, wherein said unbalance adjustment of said random balance sample is performed by material-removal, and said inertia adjustment of said balance is also performed by material-removal to form a sprung balance assembly of oscillation frequency, according to the measured torque of said balance spring.

* * * * *